United States Patent [19]

Miyake et al.

[11] 4,234,305

[45] Nov. 18, 1980

[54] TRANSFER SHEET GUIDING DEVICE

[75] Inventors: Hiroyuki Miyake, Inagi; Kazumi Umezawa, Kawasaki; Hiroshi Ogawa, Yokohama; Hitotoshi Kishi, Tokyo; Seiji Sagara, Kawasaki; Hiroshi Hara, Tokyo, all of Japan

[73] Assignee: Canon Kabushiki Kaisha, Tokyo, Japan

[21] Appl. No.: 961,780

[22] Filed: Nov. 17, 1978

[30] Foreign Application Priority Data

Nov. 24, 1977 [JP] Japan ..... 52/141003
Dec. 1, 1977 [JP] Japan ..... 52/144310
Feb. 15, 1978 [JP] Japan ..... 53/15374

[51] Int. Cl.[3] ..... F27B 9/28; B65H 29/16; B65H 29/56

[52] U.S. Cl. ..... 432/59; 219/216; 271/188; 271/198; 271/311; 355/3 FU; 355/3 SH

[58] Field of Search ..... 271/174, DIG. 2, 80, 271/188, 209, 275, 19 B, 307, 308, 309, 310, 311, 312, 313; 432/59; 226/171, 196, 197; 219/216; 355/3 FU, 3 SH, 3 TR

[56] References Cited

U.S. PATENT DOCUMENTS

| | | | |
|---|---|---|---|
| 3,511,497 | 5/1970 | Flanagan | 271/198 X |
| 3,864,709 | 2/1975 | Bruns | 219/216 X |
| 3,936,045 | 2/1976 | Ariyama | 271/174 |
| 4,009,877 | 3/1977 | Ward | 226/171 X |
| 4,013,354 | 3/1977 | Komori et al. | 355/3 R |
| 4,059,394 | 11/1977 | Ariyama et al. | 432/59 |
| 4,162,786 | 7/1979 | Bullock | 271/64 |

FOREIGN PATENT DOCUMENTS

| | | | |
|---|---|---|---|
| 1436571 | 5/1976 | United Kingdom | 355/3 FU |

OTHER PUBLICATIONS

Bakker et al., *IBM Technical Disclosure Bulletin*, vol. 19, No. 4, Sep. 1976, pp. 1332–1333.

*Primary Examiner*—Bruce H. Stoner, Jr.
*Attorney, Agent, or Firm*—Fitzpatrick, Cella, Harper & Sointo

[57] ABSTRACT

A transfer sheet guiding device for guiding a transfer sheet along a predetermined path. The device includes a separating member for separating one lateral side of a transfer sheet from an image carrying member, a rotary body, located adjacent the one lateral side for gripping the separated side of the transfer sheet and guiding it away from the image carrying member, a guide member having a stepped portion which extends across the transport path of the transfer sheet, the position of stepped portion being disposed progressively further downstream in the advancing direction of the transfer sheet from the side where the rotary body is provided to the opposite side, and a rotary member which extends along the rotary body and guide member at the one lateral side for gripping the separated side of the transfer sheet and guiding it downwardly at least along the stepped portion in cooperation with the rotary body and guide member. The device may further include a heater for the guide member so that it also operates as a hot plate fixing device.

10 Claims, 14 Drawing Figures

TRANSFER SHEET GUIDING DEVICE

BACKGROUND OF THE INVENTION

1. Field of the Invention

The present invention relates to a transfer sheet guiding device adapted for use in an electrophotographic imaging apparatus, and more particularly to a transfer sheet guiding device for forcedly guiding and separating a transfer sheet from a latent image carrying member after the transfer therefrom of an electrostatic latent image or a visible image developed therefrom onto said transfer sheet.

The present invention further relates to a transfer sheet guiding device wherein a surface of the guiding means can be utilized as a so-called hot plate fixing device for heat fixing of an image on said transfer sheet.

2. Description of the Prior Art

Generally in an imaging apparatus utilizing electrophotography such an electrophotographic copier, there is provided an electrostatic latent image carrying member such as a drum-shaped photosensitive member provided with a photoconductive layer, and a reproduced image of an original is produced during rotation of said photosensitive member. In such apparatus there are provided charging means, exposure means and developing means along the periphery of said rotary photosensitive member, for producing an electrostatic latent image corresponding to an original image, said latent image being rendered visible by development with toner particles. The visible image thus obtained on the photosensitive member is thereafter transferred electrostatically onto a transfer sheet such as plain paper and fixed thereon for use. On the other hand the photosensitive member, after said transfer, is cleaned of remaining toner particles in preparation for the next imaging cycle.

At the above-mentioned transfer it is generally necessary to apply an electric field, by a voltage applying means such as a corona discharger or a roller electrode, in order to transfer the developer, or toner particles, onto the transfer sheet. This is usually achieved with a corona discharger by providing the transfer sheet with an electrostatic charge, which strongly attracts the latent image on the photosensitive member, resulting in an electrostatic intimate adhesion of the transfer sheet to the photosensitive member. Such adhesion is indispensable for transfer of toner particles without distortion to the transfer sheet during the transfer process. After the completion of said transfer step, however, it becomes necessary to forcibly separate the transfer sheet from the photosensitive member by means of suitable separating means in order to advance said transfer sheet to the fixing means. For such separating means there are already proposed a vacuum suction method and an air blow method in which compressed air of an elevated pressure is blown from blowing means such as a nozzle. Such air-operated separating mechanisms, however, inevitably involve a compressor or a pump and pipes for guiding compressed air or vacuum to desired positions, thus leading to increased size or cost of the imaging apparatus and also to the creation of noise. In order to avoid such drawbacks associated with such air-operated separating mechanisms there is also known a separating method utilizing a separating belt.

FIG. 1 shows, in a perspective view, the conventional separating method utilizing a separating belt, in which a transfer sheet P supplied to a photosensitive drum 1 is transported along the periphery thereof, while a side edge of said sheet is separated from the peripheral surface of the drum by means of a separating belt B. As said belt B is supported by the pulleys 5, 6, 7, 8 and 9 so as to be separated from the surface of drum 1 along a turn roller 2, the transfer sheet P is pinched at a side edge thereof between said separating belt B and turn roller 2 and is thus separated from the drum 1.

In said separation, however, as shown in FIG. 2, the opposite side edge of sheet P, being separated from the surface of a guide roller 2*a* provided adjacent to said turn roller 2, is left in a very unstable state and is delayed in advancement with respect to said pinched side edge. Consequently the transfer sheet P advances in a direction (represented by the arrow 3) different from the driving direction (represented by the arrow 4) of advancing rollers R, and the leading end of sheet P does not simultaneously reach said rollers R. For this reason the rollers R are unable to realize stable sheet advancement, thus frequently resulting in wrinkle formation and sheet jamming.

As explained in the foregoing, the diagonal advancement of transfer sheet is almost unavoidable in such separating method with a separating belt, though it is advantageous in the simplicity of mechanism and secure separating operation. Besides, the extent of said diagonal advancement strongly varies according to the stiffness of transfer sheet, adhesion of drum and said sheet, pinching force exerted on the sheet by the separating belt and roller etc. For this reason such a separating mechanism will result in frequent troubles such as sheet jamming or diagonal feeding and is unable to ensure satisfactory fixing or roller feeding in the succeeding step.

SUMMARY OF THE INVENTION

An object of the present invention is to provide a transfer sheet guiding device capable of assuredly separating and guiding the transfer sheet by stably controlling the behavior of the transfer sheet.

Another object of the present invention is to provide a transfer sheet guiding device capable of preventing diagonal feeding of transfer sheet thereby significantly reducing the frequency of sheet jamming.

Yet another object of the present invention is to provide a transfer sheet guiding device capable of maintaining the transfer sheet, during transportation thereof, in pressure contact with a guide surface thereby achieving an elevated fixing efficiency when said guide surface is utilized as a fixing hot plate.

DESCRIPTION OF THE PREFERRED EMBODIMENTS

Now the present invention will be explained in detail by the preferred embodiments thereof.

Figure 1:
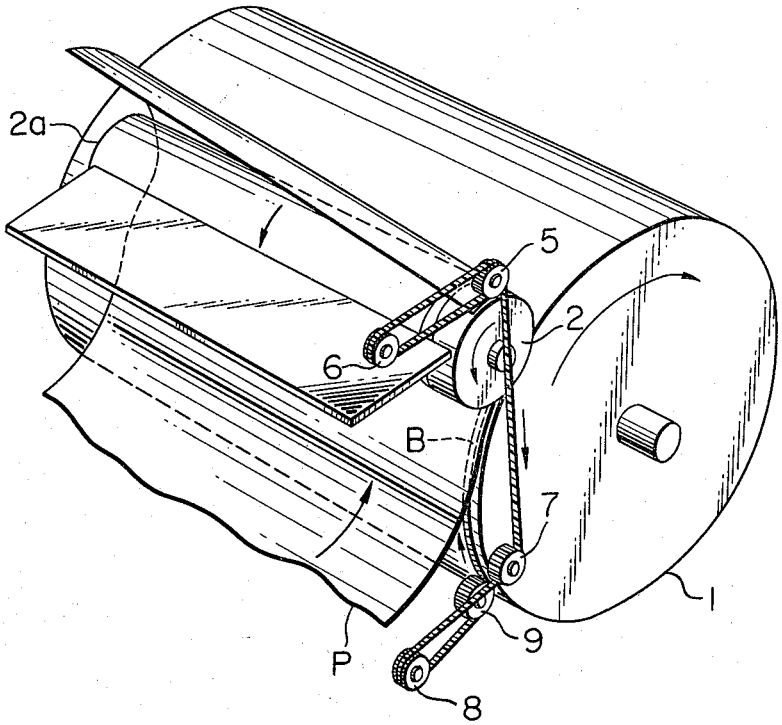
FIG. 1 PRIOR ART
FIG. 1 is a perspective view of a conventional separating mechanism.
Figure 2:
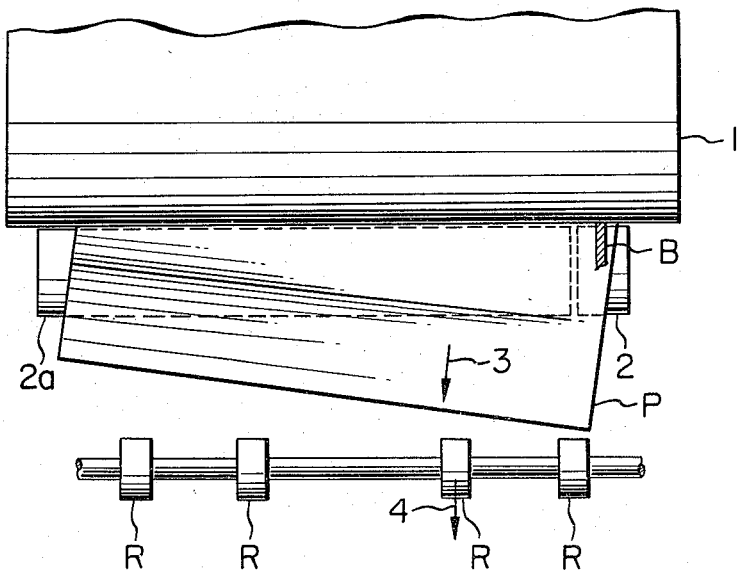
FIG. 2 PRIOR ART
FIG. 2 is a plan view thereof.
Figure 3:
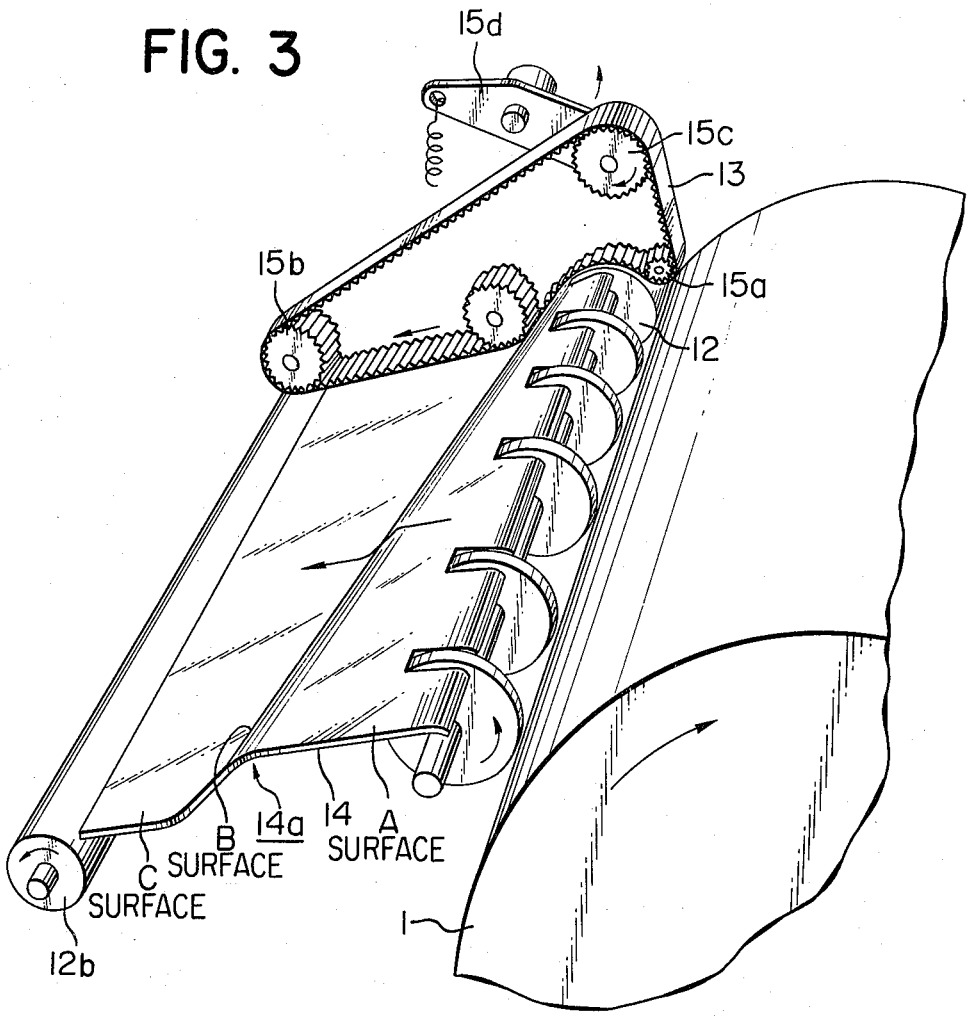
FIG. 3 is a perspective view of an embodiment of the present invention.
Figure 4:
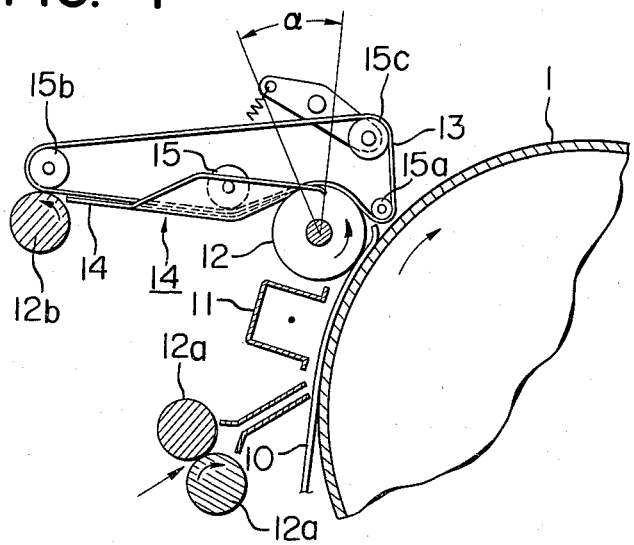
FIG. 4 is a lateral view thereof.
Figure 5:
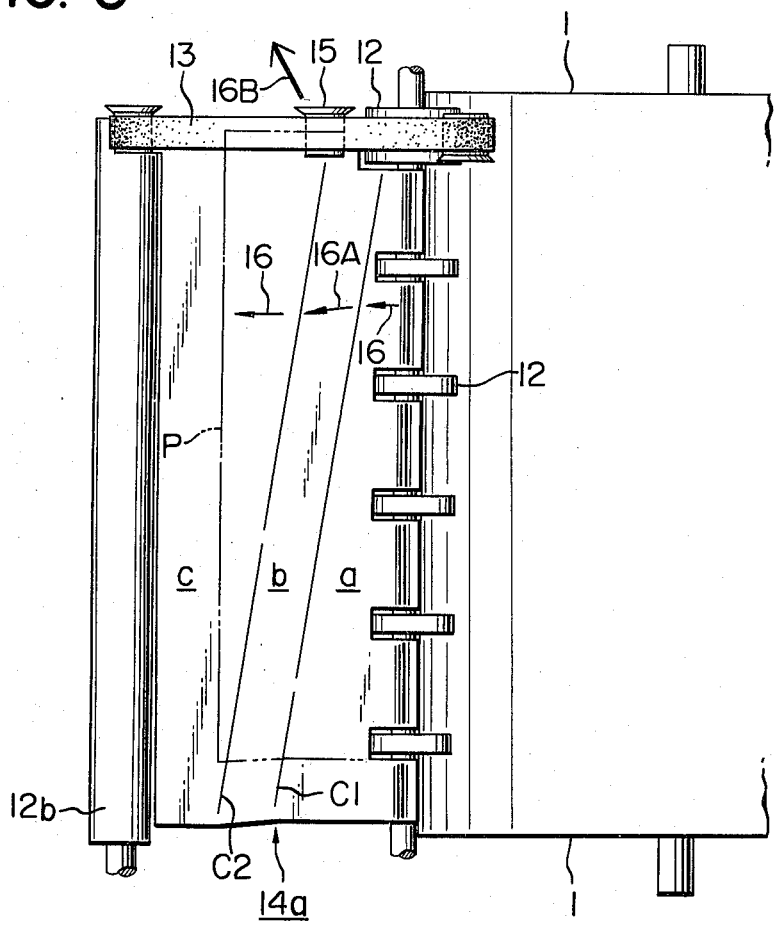
FIG. 5 is a plan view thereof.

Referring to FIGS. 3, 4 and 5 showing an embodiment of the present invention by way of a perspective view, a lateral view and a plan view, there is provided, at an end portion of photosensitive drum 1, a strip-shaped fixed separating guide 10 for guiding a side edge of a transfer sheet in a direction away from said drum 1. The transfer sheet is advanced by a timing roller 12*a* in synchronization with the image formed on said drum 1 and is subjected to transfer of said image by means of a transfer charger 11 extending in the axial direction of said drum 1, then guided toward a turn roller 12 by said guide 10, and guided further in a direction away from said drum 1 when pinched between a belt 13 and roller 12. Said transfer sheet is further guided by said separating belt 13 and a guide plate 14 embodying the present invention. In the present embodiment there is further provided a drive roller 12*b* at the downstream end of said guide plate 14 to pinch the transfer sheet in cooperation with said separating belt 13 for further ensuring an advancing operation.

Said guide plate 14 constituting the path for the transfer sheet is provided with a sloping shoulder 14*a* across the entire width thereof and in a direction diagonal to the advancing direction of the transfer sheet, said sloping shoulder 14*a* being located in an upstream position on the side of separating belt 13 and in a downstream position on the opposite side. Consequently said guide plate 14 is provided with a first guide surface of substantially the same height as that of the tangent plane to said turn roller 12, a second guide surface parallel to said first guide surface and located at a lower position with respect thereto, and two parallel concave and convex cylindrical surfaces connecting said first and second guide surfaces. Said convex surface is located at an upstream position at the side of the separating belt and said concave surface is located immediately downstream to said turn roller 12, while said convex and concave surfaces are located in more downstream positions at the opposite side. Said convex and concave surfaces, constituting the sloping shoulder portion 14*a*, are respectively provided with shapes substantially coinciding with the external periphery of said turn roller 12 and the external periphery of belt 13 placed on a press pulley 15 supporting said belt. Thus said separating belt 13 is positioned to run along the configuration of the guide plate 14 provided to cover approximately half of the turn rollers 12.

Now referring to FIG. 5 showing the state of guiding and transportation of a transfer sheet in the present embodiment, the transfer sheet supplied along the periphery of turn rollers 12 is firmly pinched at one side edge thereof between the belt 13 and turn roller 12, so that the separation and advancing force progressively extend toward the opposite side. In this operation the sheet portion located on the side of separating belt 13 immediately descends, along the roller 12, from the higher guide surface a of guide plate 14 to the lower guide surface c through the sloping surface b, thus creating, according to the configuration of said guide surface a, b and c of guide plate 14, a movement of the sheet away from the separating belt 13 and thus moving in the direction 16A on the downward slope b. On the other hand the roller 12 and belt 13 firmly grip the transfer sheet against said movement in the direction 16A, thus creating a relative tension in a direction represented by an arrow 16B. As the force of the above-mentioned movement and the tension exerted by roller 12 and belt 13 thereagainst are applied along the stiff surface of transfer sheet, said sheet is maintained in pressure contact with the guide plate 14 and is stroked through by the convex portion C1 of the downward slope b of sloping shoulder 14*a*.

Successively the transfer sheet is transported from the downward slope b to the lower guide surface c parallel to the original advancing direction, and is thus returned to the original advancing direction 16. In this change of advancing direction from the surface b to surface c, the transfer sheet is pressed against the surface of guide plate 14. In the above-explained manner the transfer sheet supplied along the turn rollers 12 is guided in a correct direction without lateral displacement or diagonal advancement, and is transported along the guide plate 14 without danger of wrinkle formation.

As said roller 12 and belt 13 are provided to apply a tension in a direction 16B on side edge portion of transfer sheet against the movement in the direction 16A thereof as explained in the foregoing, the belt 13 is preferably provided with an elevated rigidity in the width direction thereof and is more advantageously composed of a dentured belt as illustrated in the drawings.

Figure 7:
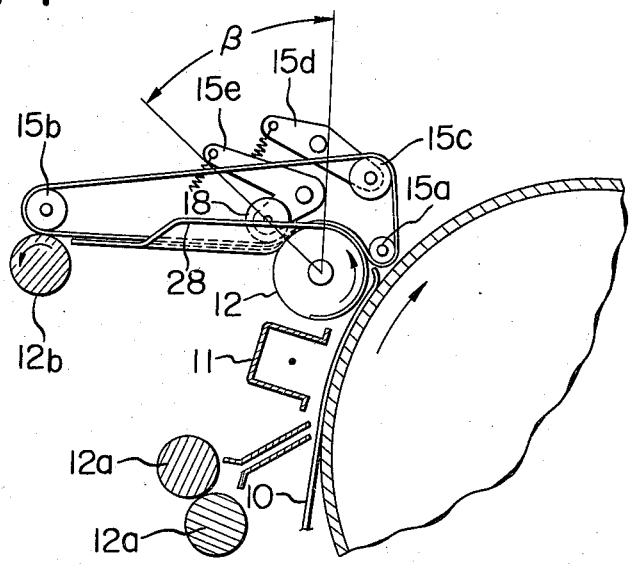
FIG. 7 is a lateral view thereof.
Figure 6:
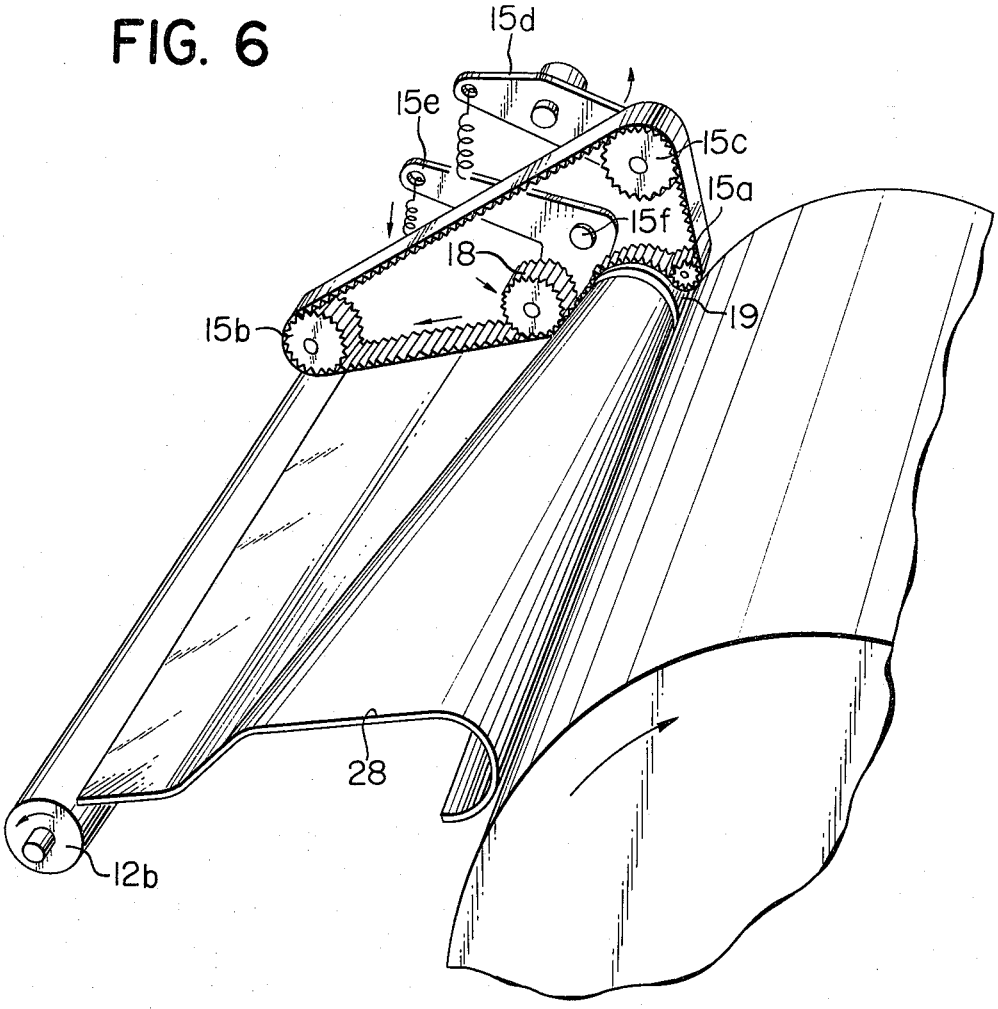
FIG. 6 is a perspective view of another embodiment of the present invention.

FIGS. 6 and 7 show an another embodiment for further enhanced prevention of lateral displacement of the transfer sheet, in which a pulley 18 is pressed against a turn roller 19 to maintain the transfer sheet by the pressure of said pulley 18 in addition of the belt tension. The pressure of said pulley 18 is generated by downwardly pulling an arm 15*e* about an axis 15*f* by a spring, and is exerted over a range $\beta$ considerably larger than the corresponding range $\alpha$ shown in FIG. 4. In this manner, therefore, it is rendered possible to maintain under pressure the transfer sheet over a longer distance and to more securely prevent the diagonal advancement of the transfer sheet. Besides, in contrast to the foregoing embodiment wherein a sloping flat plane b is provided between the cylindrical surface connecting the surfaces a and b and the cylindrical surface connecting the surfaces b and c, the cylindrical surfaces are directly interconnected in the present embodiment to provide the transfer sheet with stronger curvatures, thereby realizing a stronger stiffness of the transfer sheet. In this manner, and in combination with the stronger trip on the side edge of transfer sheet, the present embodiment provides stable control and transportation of a sheet along the configuration of the guide plate 28.

Figure 9:
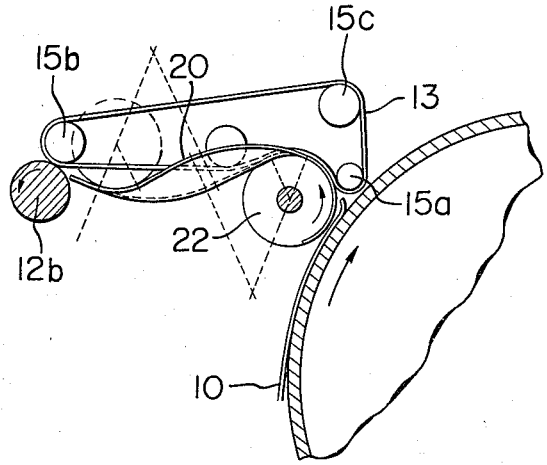
FIG. 9 is a lateral view thereof.
Figure 8:
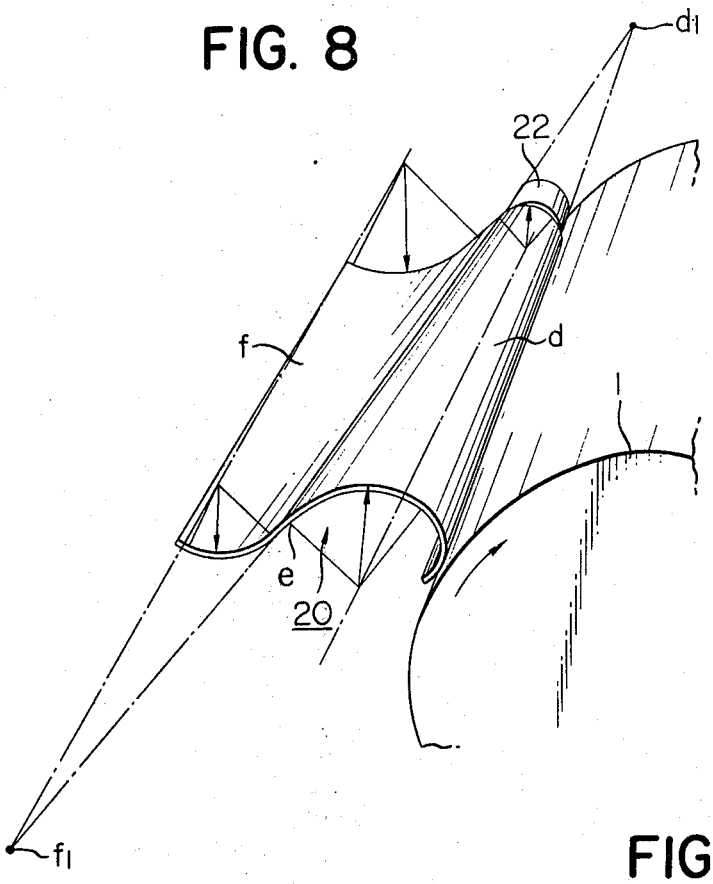
FIG. 8 is a perspective view of a still another embodiment of the present invention.

The present invention is however not limited to a configuration of guide plate provided with a sloping shoulder portion but also covers a configuration of a guide plate composed of two interconnected conical surfaces as shown in FIGS. 8 and 9. In FIG. 8 the separating belt and guide pulleys are omitted for simplicity.

In this embodiment the shoulder portion of guide plate 20 is composed of a convex conical surface d and a concave conical surface f interconnected through a sloping plane e, said conical surface d being provided with a vertex d1 located outside the turn rollers 22 and having a curvature in the vicinity of turn roller 22 identical with the curvature thereof, while the conical surface f having a vertex f1 located on the opposite side with respect to the turn roller 22. It is to be understood that the present embodiment is capable of achieving various effects achievable in the foregoing embodiments.

Figure 10:
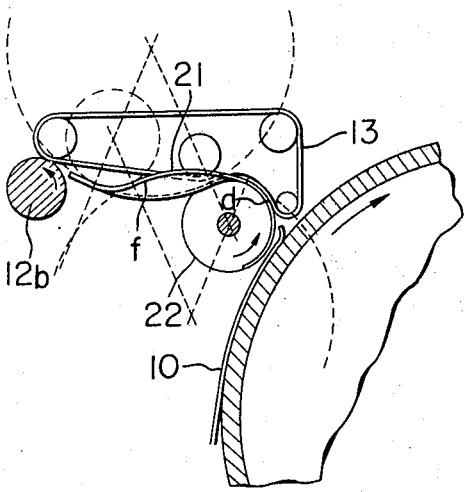
FIG. 10 is a lateral view of still another embodiment of the present invention.

FIG. 10 shows still another embodiment in which the guide plate 21 is provided with two conical surfaces d and f which are mutually connected directly on the generatrixes thereof, namely the sloping shoulder portion being constituted by direct connection of the convex surface d and concave surface f in FIG. 8. In the present embodiment as well as in the embodiment shown in FIGS. 8 and 9, the transfer sheet transported along the conical surface d shows a tendency to laterally displace away from the separating belt but said tendency is corrected by the succeeding conical surface f, whereby sheet transportation in the correct direction is ensured and the effects achievable in the embodiment shown in FIG. 3 are also expectable in these embodiments.

Figure 11:
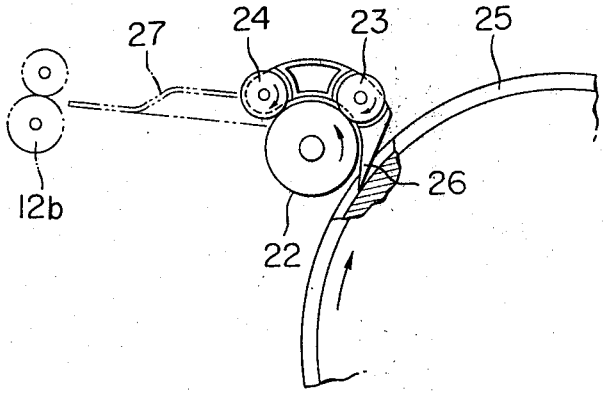
FIG. 11 is a lateral view of an embodiment wherein the present invention is applied to another oneside separating method.

FIG. 11 shows an embodiment in which the present invention is applied to an another one-side separating method, which achieves separation of a side edge of transfer sheet by means of a separating claw 26 provided in the vicinity of a groove 25 provided along an end portion of photosensitive drum 1. The transfer sheet thus separated is transported by pressure rollers 23, 24 and maintained in position along the downward sloping shoulder portion of a guide plate 27. In this manner the present invention is not necessarily limited to the one-side separating method utilizing a separating belt but also is applicable to other separating methods such as that utilizing a separating claw.

In the foregoing embodiments the separating belt is composed of rubber or resinous material of an elevated rigidity and is provided with fine-pitched dentures in order to ensure stable belt drive and thus to achieve secure gripping and guiding of the transfer sheet. It is to be however understood that the belt to be employed in the present invention is not limited to such a dentured belt but also covers ordinary endless belts, and further does not require any particularly high rigidity as long as the belt is provided with enough strength for preventing lateral displacement of the transfer sheet.

Furthermore the transfer sheet need not necessarily be an ordinary paper, though the foregoing explanation is made with the case of using such paper as the transfer sheet. Furthermore the latent image carrying member may be composed of an insulating material, and may be of other shapes than a drum.

As detailedly explained in the foregoing, the present invention is featured, in a transfer sheet separating and guiding device provided with a turn roller for separating one side edge of transfer sheet, in being provided with guide means located at the downstream side of said turn roller and having a shouldered configuration with a higher surface and a lower surface respectively in an upstream position and in a downstream position in the transport direction of transfer sheet, said shouldered portion being provided diagonally with respect to said transport direction.

In the following there will be explained an embodiment wherein the surface of said guide means is utilized as a hot plate fixing device.

Usually the fixing device is positioned immediately after the separating position of the transfer sheet onto which the powder image is transferred from the photosensitive member. Consequently the use of separating means as the fixing device provides an advantage of rendering the entire apparatus simpler and more compact.

Figure 12:
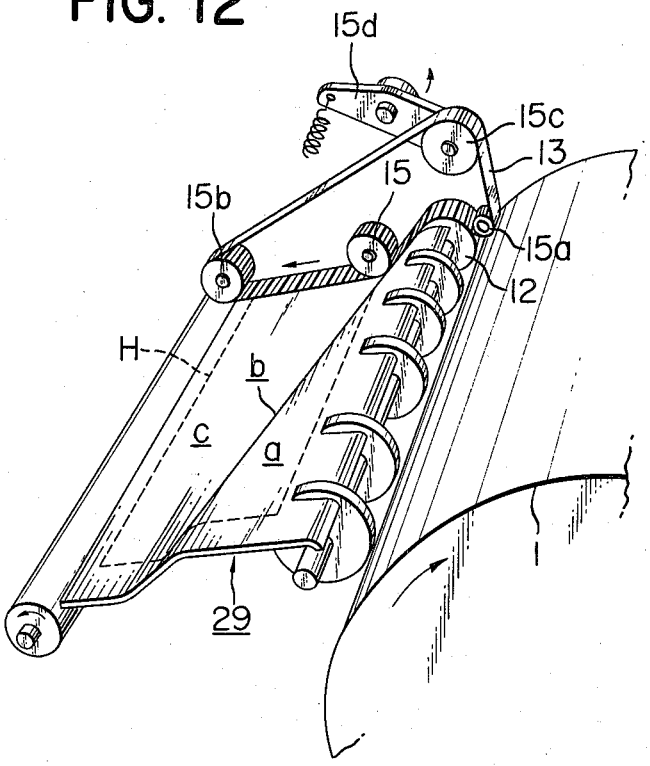
FIG. 12 is a lateral view of an embodiment wherein the guiding member of the present invention is utilized also as a hot plate.

FIG. 12 shows such an embodiment wherein a heat source H is applied on the rear side of the guide place in the embodiment shown in FIG. 3. In this manner the transfer sheet P is transported without wrinkle formation and in close contact with a guide-heat member 29 as explained in connection with FIG. 3, and a powder image carried on said transfer sheet P is heated and fixed by said guide-heat member 29, composed for example of aluminum, maintained at a predetermined temperature by means of said heat source H composed for example of a rubber heater. In this manner the fixation of the powder image is conducted simultaneously with the separation and transportation of transfer sheet P from the photosensitive member 1. Besides, as the contact of transfer sheet to the heating member 29 is generated by the sheet transporting force and the geometrical configuration of the surface of said member, there will not be needed other blowing or suction means for ensuring said contact.

Figure 13:
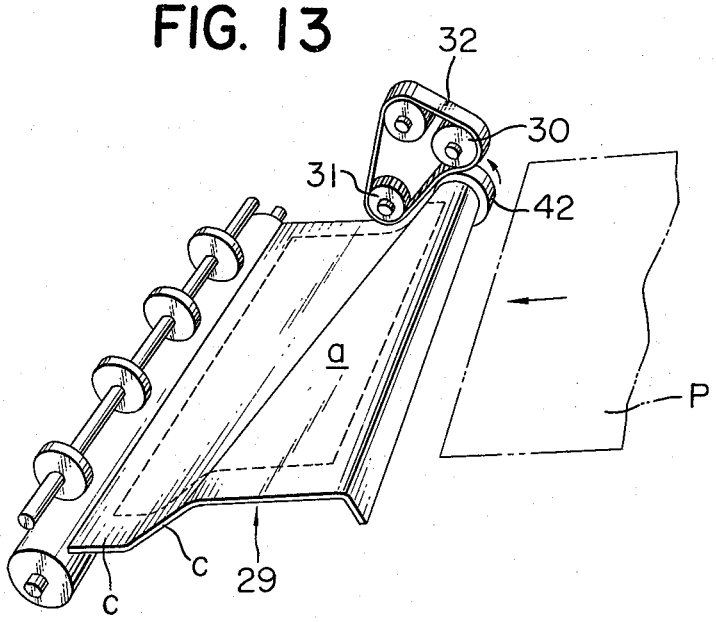
FIG. 13 is a lateral view of an embodiment wherein the guide member is utilized as a fixer.

In case the fixing device is provided independently from the separating device, it can be advantageously positioned in the sheet path as shown in FIG. 13, wherein the transfer sheet P supplied from a preceding step is advanced, by means of rollers 42, 30, 31 and a belt 32, onto a guideheat member 29. In this manner the transfer sheet P is guided and transported in intimate contact with said member 29 functioning as a hot plate and efficiently receives heat therefrom to undergo satisfactory fixation. Particularly in an electrofax process a fixing device as explained above is advantageously employed in the sheet path.

Figure 14:
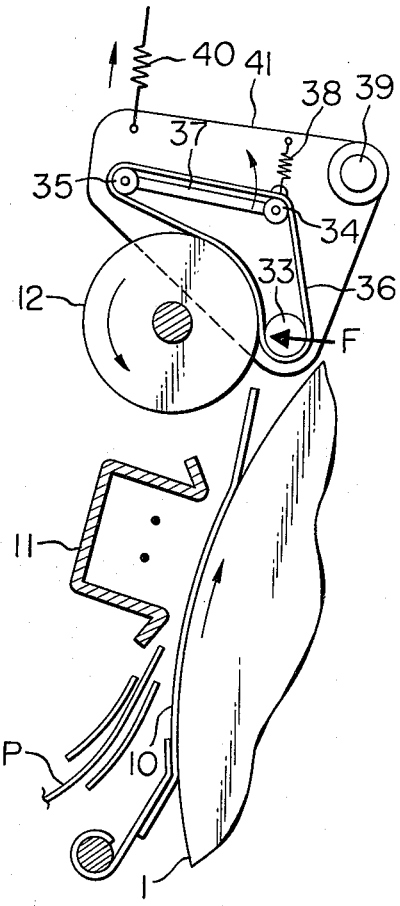
FIG. 14 is a lateral view of another embodiment of the separating mechanism applicable in the present invention.

Furthermore the separating mechanism employed in the foregoing embodiments may also be structured as shown in FIG. 14, in which an endless belt 36 supported by pulleys 33, 34 and 35 is maintained in pressure contact with the periphery of a separating roller 12, wherein said pulley 34 being a tension pulley.

A tension arm 37 is biased by a spring 38 in a direction represented by an arrow to bias the pulley 34 in the same direction, thereby maintaining the belt 36 under tension and maintaining a portion thereof in pressure contact with the separating roller 12. In the present embodiment said pulleys 33, 34 and 35 are provided on a pulley support plate 41 which is rotatable about an axis 39 and is constantly biased by a spring 40 in a direction represented by an arrow, to rotate about said axis 39 toward the separating pulley 12. Consequently the pulley 33 provided on said plate 41 is biased in the direction F to maintain the endless belt 36 in pressure contact with the separating roller 12. The force of said pressure contact is obtained by direct application of force in the direction of separating belt and is thus far larger than that in the conventional separating belt wherein the contact pressure is obtained indirectly by applying a tension to the belt. For this reason the present embodiment is capable of achieving satisfactory separation without slipping between the transfer sheet and separating roller or separating belt even in case of separating particularly stiff transfer sheet. Said force F can even be higher than the force of spring 40 by use of a lever. Furthermore, in the present embodiment, it is possible to simplify the structure by using the shaft of pulley 35 for the rotary axis of tension arm 37. The separation and transportation of transfer sheet can therefore be achieved in a further assured manner by employing the separating mechanism as explained above in combination with the transfer sheet guide device of the present invention.

What we claim is:

1. A transfer sheet guiding device for guiding a transfer sheet along a predetermined path, comprising:

a separating member for separating one lateral side of a transfer sheet from an image carrying member;

a rotary body, located adjacent said one lateral side, for gripping the separated side of the transfer sheet and guiding the same in a direction away from the image carrying member;

a guide member provided downstream of said rotary body and having a stepped portion which extends across the transport path of said transfer sheet in such a manner that the position of said stepped portion is progressively disposed further downstream in the advancing direction of the transfer sheet from the side where said rotary body is provided to the opposite side; and a rotary member which extends along said rotary body and said guide member adjacent said one lateral side for gripping the separated side of the transfer sheet and guiding it at least along said stepped portion in cooperation with said rotary body and guide member.

2. A transfer sheet guiding device according to claim 1 wherein said guide member is provided with a heat source whereby said guide member functions as a guide-heating member for the transfer sheet to be transported.

3. A transfer sheet guiding device according to claim 1 wherein said guide member comprises a first guide surface located at substantially the same height as that of the peripheral surface of said rotary body, a second guide surface parallel to said first guide surface and located lower than said first guide surface, and a curved surface interconnecting said first and second guide surfaces.

4. A transfer sheet guiding device comprising:

a rotary body, located adjacent one lateral side of the transport path for a transfer sheet, for gripping and transporting one side of the transfer sheet;

a guide member provided downstream of said rotary body and having a stepped portion which extends across the transport path of said transfer sheet in such a manner that the position of said stepped portion is progressively disposed further downstream in the advancing direction of the transfer sheet from the side where said rotary body is provided to the opposite side;

means for heating said guide member; and a rotary member which extends along said rotary body and said guide member for gripping the one side of the transfer sheet and guiding the same downwardly at least along said stepped portion in cooperation with said rotary body and guide member.

5. A transfer sheet guiding device according to claim 4 wherein said guide member comprises a first guide surface located at substantially the same height as that of said rotary body, a second guide surface parallel to said first guide surface and located lower than said first guide surface, and a curved surface interconnecting said first and second guide surfaces.

6. A transfer sheet guiding device according to claim 1 or 4 wherein said rotary member is a belt supported by a plurality of pulleys.

7. A transfer sheet guiding device according to claim 6 wherein at least one of said plurality of pulleys maintains said belt in pressure contact with said rotary body.

8. A transfer sheet guiding device according to claim 1 or 4 wherein said stepped portion of said guide member comprises a convex cylindrical surface and a concave cylindrical surface interconnected by a planar downwardly sloping surface.

9. A transfer sheet guiding device according to claim 1 or 4 wherein said stepped portion of said guide member comprises a convex cylindrical surface and a concave cylindrical surface connected together directly.

10. A transfer sheet guiding device according to claim 1 or 4 wherein said guide member is provided with a convex surface so as to form a higher surface in the upstream portion and a concave surface so as to form a lower surface in the downstream portion with respect to the advancing direction of the transfer sheet, said convex surface extending diagonally with respect thereto so that it is at a more upstream position on said one lateral side and at a more downstream position on said opposite side and being provided with a curvature substantially the same as that of said rotary body.

* * * * *